US006408548B1

(12) United States Patent
Altheide

(10) Patent No.: US 6,408,548 B1
(45) Date of Patent: Jun. 25, 2002

(54) PIVOTAL REAR-MOUNTED SNOWPLOW

(76) Inventor: Charles E. Altheide, P.O. Box 78, Bloomfield, IA (US) 52537

( * ) Notice: Subject to any disclaimer, the term of this patent is extended or adjusted under 35 U.S.C. 154(b) by 0 days.

(21) Appl. No.: 09/596,411

(22) Filed: Jun. 19, 2000

Related U.S. Application Data

(63) Continuation-in-part of application No. 09/224,249, filed on Dec. 30, 1998, which is a continuation-in-part of application No. 08/819,706, filed on Mar. 12, 1997, now Pat. No. 5,930,922.

(51) Int. Cl.[7] ..... E01H 5/06
(52) U.S. Cl. ..... 37/268; 37/232; 37/236
(58) Field of Search ..... 37/231, 232, 235, 37/236, 266, 268, 234; 172/684.5, 677, 272

(56) References Cited

U.S. PATENT DOCUMENTS

| | | | | | |
|---|---|---|---|---|---|
| 2,059,818 | A | | 11/1936 | Simon | 37/5 |
| 3,250,026 | A | | 5/1966 | Jocher et al. | 37/42 |
| 3,587,751 | A | | 6/1971 | Schmidt, Jr. | 172/264 |
| 3,755,930 | A | * | 9/1973 | Brandt et al. | 172/743 X |
| 3,800,447 | A | | 4/1974 | Harvey | 37/41 |
| 3,893,248 | A | * | 7/1975 | Young | 37/41 |
| 4,145,825 | A | | 3/1979 | Bertolino | 37/42 |
| 4,215,494 | A | * | 8/1980 | Farrell et al. | 37/42 R |
| 4,403,432 | A | | 9/1983 | Biance | 37/235 |
| 4,506,465 | A | | 3/1985 | Johnson | 37/268 |
| 4,658,519 | A | * | 4/1987 | Quenzi | 37/23 |
| 4,754,562 | A | | 7/1988 | McGarrah et al. | 37/232 |
| 4,802,293 | A | * | 2/1989 | Smith | 37/108 R |
| 4,907,357 | A | | 3/1990 | Lillienthal | 37/197 |
| 5,046,271 | A | | 9/1991 | Daniels | 37/231 |
| 5,050,322 | A | | 9/1991 | Burkard | 37/270 |
| 5,058,295 | A | | 10/1991 | Holland | 37/268 |
| 5,209,307 | A | * | 5/1993 | Hotte | 172/445.2 |
| 5,265,355 | A | | 11/1993 | Daniels | 37/236 X |
| 5,285,588 | A | | 2/1994 | Niemela et al. | 37/234 |
| 5,392,538 | A | | 2/1995 | Geerligs et al. | 37/268 |
| 5,568,694 | A | * | 10/1996 | Capra et al. | 37/231 |
| 5,595,007 | A | | 1/1997 | Biance | 37/268 |
| 5,647,153 | A | | 7/1997 | Gervais | 37/231 |
| 5,930,922 | A | * | 8/1999 | Altheide | 37/268 |
| 6,070,343 | A | * | 6/2000 | Sheldon | 37/267 |
| 6,151,809 | A | * | 11/2000 | Altheide | 37/268 |

FOREIGN PATENT DOCUMENTS

| | | | | |
|---|---|---|---|---|
| CH | NR. 245009 | | 6/1947 | |
| FR | 1029542 | * | 6/1953 | 37/268 |

OTHER PUBLICATIONS

Daniels Pull Plow brochure "We've Redefined Residential Snow Plowing." 15N365 Old Sutton Road, East Dundee, IL 60118.

* cited by examiner

*Primary Examiner*—Victor Batson
(74) *Attorney, Agent, or Firm*—McKee, Voorhees & Sease, P.L.C.

(57) ABSTRACT

A pivotal snowplow is provided for mounting to the hitch on the rear end of a vehicle, such as a pickup truck. The snowplow includes a frame and a blade. The frame includes a tongue for mating receipt in the vehicle hitch socket. The frame also includes rearwardly extending arms and downwardly extending legs mountable to the snowplow blade. A hydraulic cylinder controls movement of the blade between raised and lowered positions. The legs of the frame are pivotally mounted to the arms of the frame such that the blade can be rotated about a vertical axis, thereby angling the blade relative to the direction of travel of the vehicle. The blade includes trip springs so that the blade can be tilted to pass over obstacles encountered during plowing. A pair of down pressure springs on the frame apply a downward force on the blade for improved snow removal.

8 Claims, 3 Drawing Sheets

PIVOTAL REAR-MOUNTED SNOWPLOW

This application is a continuation in part of application Ser. No. 09/224,249 filed on Dec. 30, 1998; and application Ser. No. 08/819,706 filed on Mar. 12, 1997 and issued on Aug. 3, 1999 as U.S. Pat. No. 5,930,922.

BACKGROUND OF THE INVENTION

Numerous types of snowplows are known for mounting on the front and back of vehicles, such as pickup trucks. Most front plows cannot be used on small and lightweight trucks, since they do not meet governmental crash worthiness requirements. Front plows require mounting brackets attached to the vehicle. Rear-mounted plows typically are bolted to the frame of the truck, which is a time consuming process, and which limits the height that the plow can be raised. Other prior art plows are mounted on the receiver of a hitch on the rear of the truck, but are not pivotal so as to direct the snow laterally.

Accordingly, a primary objective of the present invention is the provision of a rear-mounted snowplow that is laterally pivotal.

A further objective of the present invention is the provision of a snowplow that can be quickly and easily mounted to the rear of any vehicle having a hitch.

Another objective of the present invention is the provision of a rear-mounted snowplow that can be raised substantially above the ground.

Another objective of the present invention is the provision of a rear-mounted snowplow having trip springs so that the plow blade will tilt to pass over obstructions encountered during plowing.

Another objective of the present invention is the provision of a rear-mounted snowplow that is economical to manufacture and durable and safe in use.

Another objective is the use of a T-mount for mounting the hydraulic power unit so the complete plow with hydraulics is removed when the plow is unhooked from the vehicle at the receiver hitch.

These and other objectives become apparent from the following description of the invention.

SUMMARY OF THE INVENTION

The pivotal snowplow of the present invention is adapted to be mounted in a center hitch on the rear of a vehicle, such as a pickup truck. The snowplow includes a frame, with a forwardly extending tongue for receipt in the hitch. A pin locks the tongue to the hitch.

The snowplow frame includes a cross bar connected to the tongue, a pair of substantially horizontal arms extending rearwardly from the cross bar, and a pair of vertical legs extending downwardly from the arms for attachment to the blade. The legs are pivotally connected to the arms about a vertical axis, such that the blade can be angled relative to the direction of travel. The vertical legs extend behind a snowplow blade for pivotal attachment to the rearward surface thereof. The plow includes trip springs to allow the blade to tilt and pass over obstacles encountered during plowing. A hydraulic cylinder moves the blade between raised and lowered positions. A pair of hydraulic cylinders pivot the blade to a desired angular orientation. The plow has two down pressure springs that attach to the upper pivot arms and the crossbar to provide down pressure to the blade, thereby producing a cleaner scrape or removal of snow.

DETAILED DESCRIPTION OF THE DRAWINGS

Figure 1:
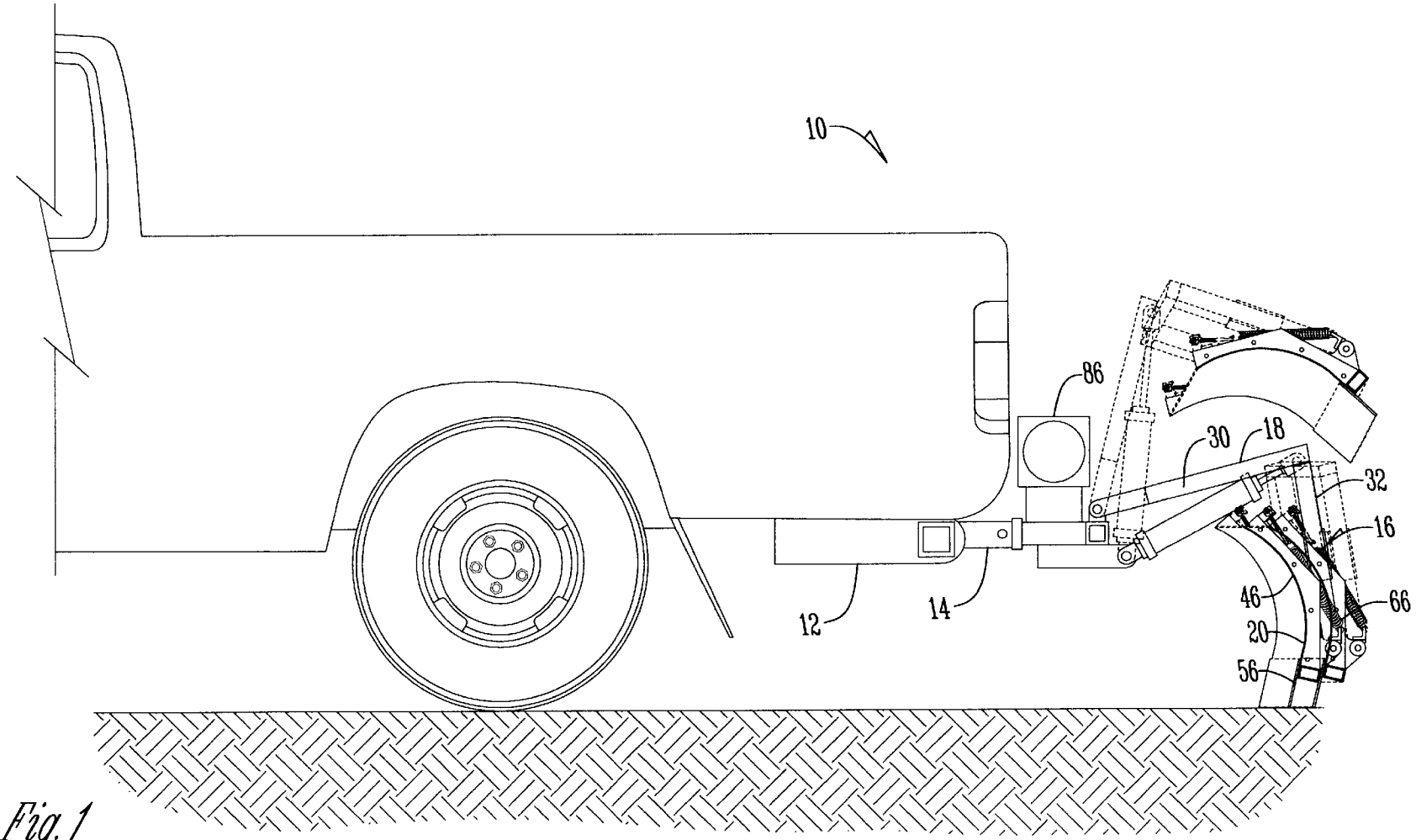
FIG. 1 is a side elevation view of the pivotal snowplow of the present invention mounted on the hitch on the rear end of a pickup truck, with the down pressure springs excluded for clarity.
Figure 2:
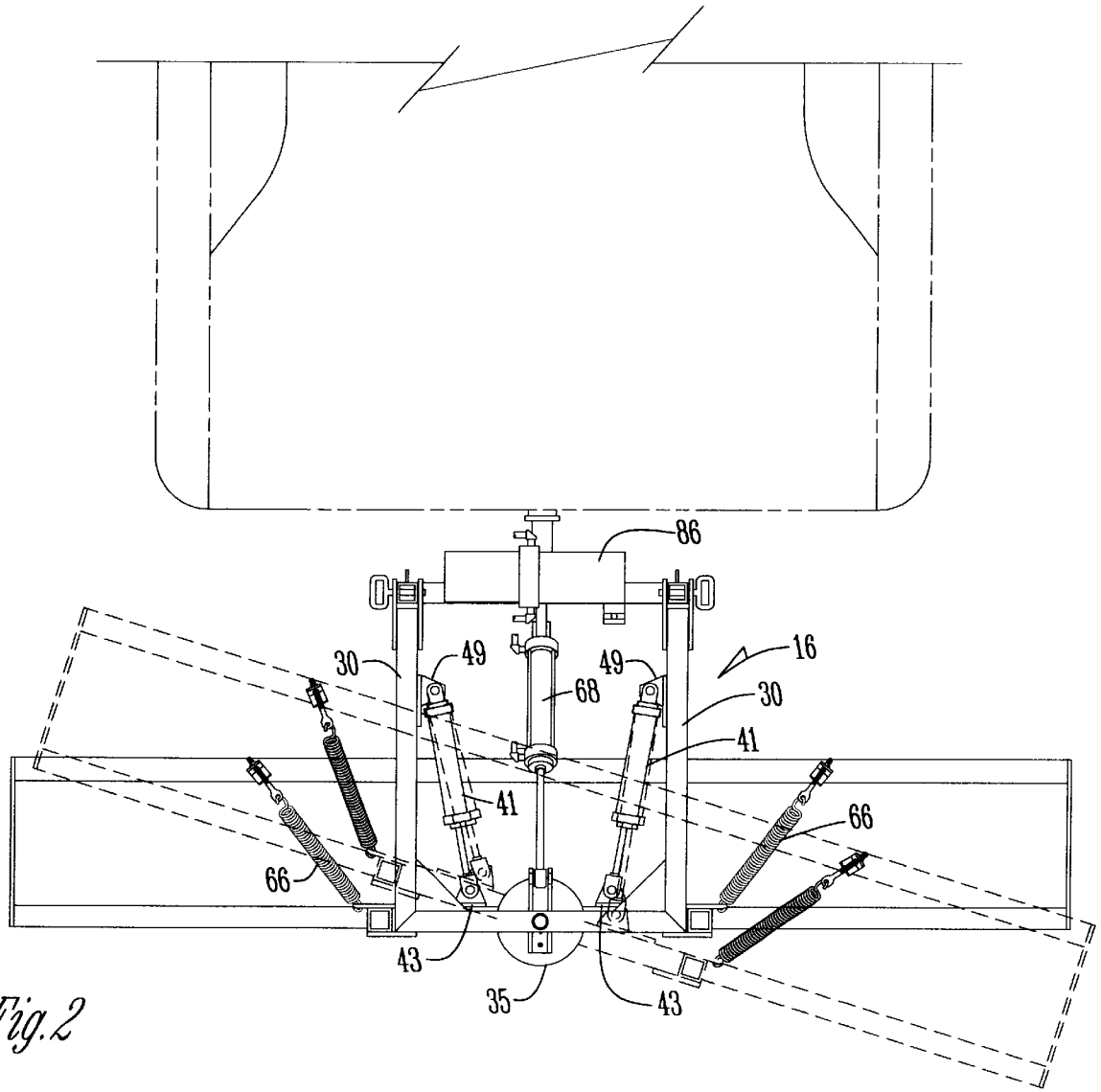
FIG. 2 is a top plan view of the plow of FIG. 1.

In FIG. 1, a pickup truck is generally designated by the reference numeral 10. The truck has a hitch 12 mounted to the truck frame in a conventional manner. The hitch 12 includes a socket or central receiver 14. The hitch 12 is conventional and does not constitute a part of the present invention.

The present invention is directed towards a pivotal snowplow 16. Preferably, the snowplow 16 is mounted on the receiver 14 of the hitch 12 of the pickup truck 10, but may also be mounted to the hitch cross bar or to the truck frame. It is understood that the plow 16 may also be used on a hitch mounted on other vehicles, other than a pickup truck.

The snowplow 16 generally includes a frame 18 and a blade 20. The blade 20 of the snowplow 16 is pivotal about a vertical axis so that the blade can be angled relative to the direction of travel of the vehicle 10, as shown in broken lines in FIG. 1. The frame 18 includes a cross bar 22 having a forwardly extending tongue 24 adapted to be received in the hitch socket 14. A conventional hitch pin 26 and lock pin 28 secure the tongue 24 in the hitch socket 14.

The frame 18 further includes a pair of laterally spaced apart arms 30 extending rearwardly from the cross bar 22 and with a rear cross bar 31 extending between the rearward ends thereof. A pair of laterally spaced apart legs 32 interconnected by a cross bar 33 extending downwardly adjacent the rearward ends of each of the arms 30.

The frame arms 30 and legs 32 are pivotally connected for rotation about a vertical axis. Preferably, an upper pivot plate 35 is mounted on the bottom of a cross bar 31 extending between the frame arms 30 and a lower pivot plate 37 is mounted on the top of a cross bar 33 extending between the legs 32. Each of the pivot plates 35, 37 includes a central aperture for receiving a nut and bolt assembly 39 such that the legs 32 are pivotal about the axis of the nut bolt assembly 39 relative to the arms 30.

Figure 3:
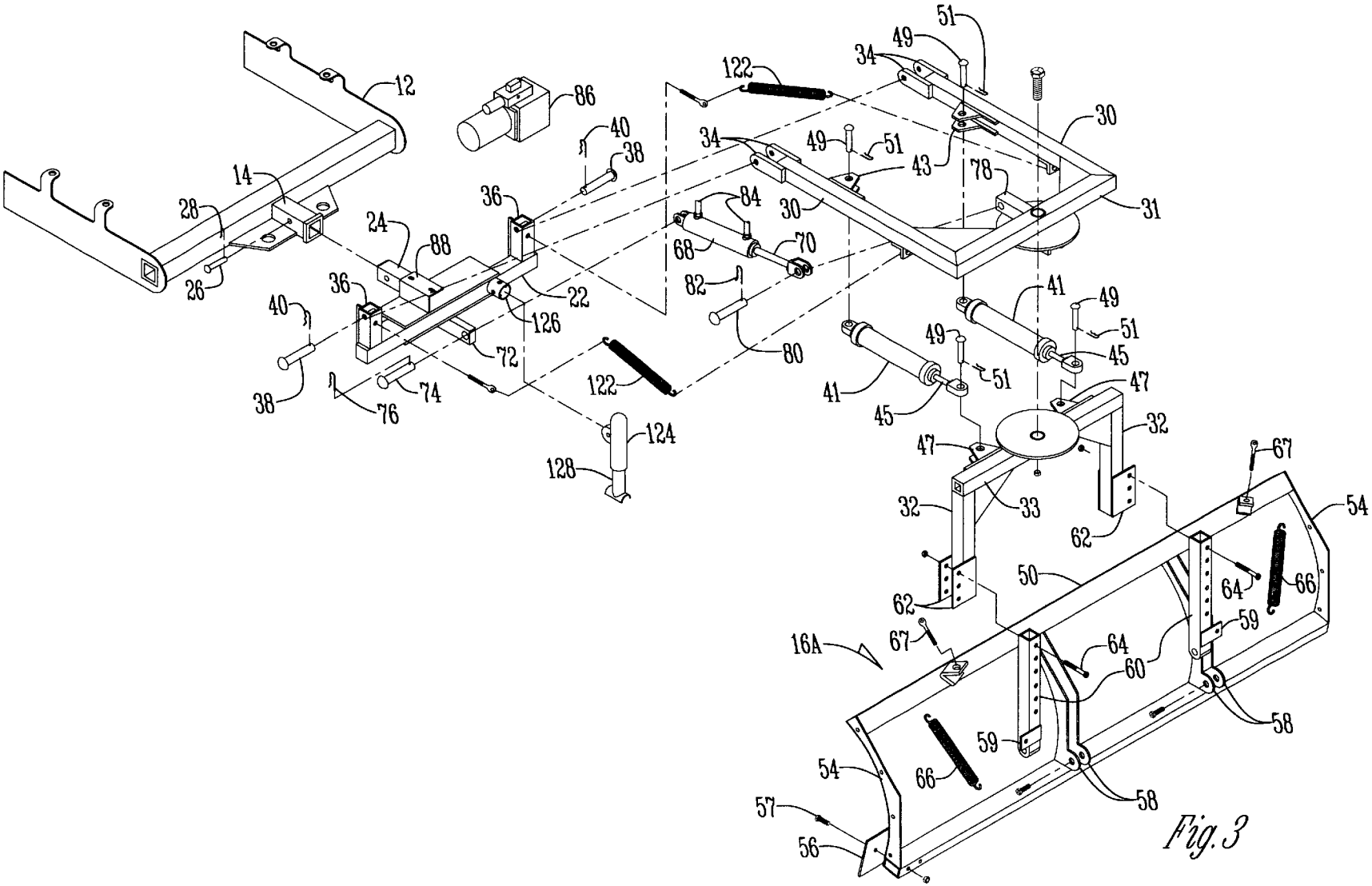
FIG. 3 is an exploded perspective view of the frame components and blade of the snowplow.

A pair of hydraulic cylinders 41 are mounted to ears 43 on each of the arms 30, with the arms 45 of the cylinders 41 being connected to ears 47 on the cross bar 33 or on the legs 32. As shown in FIG. 3, hitch pins 49 and locking pins 51 are used to mount the hydraulic cylinders 41 and the arms 45 to the frame arms 30 and legs 32, respectively. Appropriate hydraulic fluid lines (not shown) operatively connect the cylinders 41 to a hydraulic fluid source.

The arms 30 are relatively horizontal and the legs 32 are relative vertical when the plow 16 is in a lowered position, as seen in solid lines in FIG. 1. The forward end of each arm 30 includes a yoke 34 adapted to mount on an upright stub 36 on opposite ends of the cross bar 22. A hitch pin 38 extends through aligned apertures in the yokes 34 and stubs 36 and is retained by a lock pin 40.

The blade 20 includes a front surface 46, a rear surface 48, a top edge 50, a bottom edge 52, and opposite side edges 54. A scraper bar 56 is removably secured to the blade 20 adjacent the bottom edge 52 with bolts 57, as best seen in FIGS. 1 and 3.

Two pairs of tabs 58 extend rearwardly from the rear surface 48 of the blade 20. A pair of upright mounting posts 60 are pivotally bolted to the tabs 58. The legs 32 of the frame 18 terminate in plates or yokes 62 adapted to fit around the mounting posts 60 of the blade 20, and be secured thereto by nut and bolt assemblies 64. As seen in FIG. 3, the mounting posts 60 and the yokes 62 each include a plurality of holes to permit vertical adjustability in the connection between the posts 60 and legs 32.

A plurality of trip springs 66 are provided on the back of the plow blade 20. The trip springs 66 have an upper end attached to the blade 20 adjacent the upper edge 50 thereof by a bolt 67 and a lower end attached to a tab 59 of the posts 60 adjacent the lower end thereof. The trip springs 66 allow the blade 20 to tilt by pivoting about the horizontal axis defined by bolts (not shown) extending through apertures in the tabs 58 on the rear surface 48 of the blade 20. Accordingly, the blade will tilt or pivot so as to pass over obstacles encountered during plowing. The general structure and connections of the trip springs 66 are disclosed in Applicant's co-pending application Ser. No. 09/224,249, which is incorporated herein by reference.

The snowplow 16 includes a hydraulic system for moving the frame 18 and blade 20 between a lowered plow position, shown in solid lines in FIG. 1, and a raised transport position, shown in broken lines in FIG. 1. More particularly, the hydraulic system includes a hydraulic cylinder 68 with an extensible and retractable arm 70. The forward end of the cylinder 68 is mounted to an arm 72 on the cross bar 22, and secured thereto by a hitch pin 74 and lock pin 76. The rearward end of the hydraulic arm 70 is secured to an arm 78 on the cross bar 31 via a hitch pin 80 and lock pin 82. Conventional hydraulic fluid lines 84 operatively connect the hydraulic cylinder 68 to a hydraulic power source 86. As seen in FIG. 1, the hydraulic fluid tank 86 is mounted on the cross bar 22, but it is understood that the fluid source may be located remote from the snowplow 16. In a preferred embodiment, the cross bar 22 is provided with a support bracket 88 for a hydraulic fluid pump (not shown). While not shown in the drawings, it is understood that conventional controls provide for actuating the hydraulic power source 86, and thus the hydraulic cylinders 41 and 68 of the present invention.

The plow 16 also includes a pair of springs 122 extending between the arms 30 and the crossbar 22. The springs 122 exert down pressure on the blade during use, so as to produce a cleaner scrape or removal of snow.

The plow also includes a jack 124 which is mounted to a socket 126 on the cross bar 22. The jack 124 includes a leg 128 which can be retracted when the plow 16 is mounted to the vehicle, and which can be extended when the plow is detached from the vehicle. When the plow 16 is unhooked from the vehicle, the hydraulic power vent 86 uncoupled from the controls so as to remain on the cross bar 22.

The preferred embodiments of the present invention have been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. A snowplow, comprising:

a first frame member having a front end adapted to be mounted behind a vehicle and having a rear end;

a second frame member having an upper end pivotally connected to the rear end of the first frame member for rotation about a vertical axis and having a lower end;

a blade mounted on the lower end of the second frame member; and a hydraulic system connected to the second frame member to control pivotal movement about a vertical axis of the second frame member and blade relative to the first frame member.

2. The snowplow of claim 1 wherein the second frame member extends behind the blade for attachment thereto.

3. The snowplow of claim 1 wherein the blade is pivotally connected to the second frame member for rotation about a horizontal axis.

4. The snowplow of claim 3 further comprising trip springs mounted between the second frame member and the blade to normally urge the blade to a plow position.

5. The snowplow of claim 1 further comprising a hydraulic system for raising and lowering the blade.

6. The snowplow of claim 1 wherein the first frame member resides in a plane above the blade when the blade is in an operative position.

7. The snowplow of claim 1 wherein the blade is vertically adjustably connected to the second frame member.

8. The snowplow of claim 1 further comprising at least one spring mounted on the second frame member to exert downward pressure on the blade during plowing.

* * * * *